US009777236B2

(12) United States Patent
Weiss et al.

(10) Patent No.: US 9,777,236 B2
(45) Date of Patent: Oct. 3, 2017

(54) INTEGRATED PROCESS FOR DIALKYLDISULFIDES TREATMENT

(71) Applicant: TOTAL SA, Courbevoie (FR)

(72) Inventors: Claire Weiss, Vaucresson (FR); Kamlesh Ghodasara, Courbevoie (FR)

(73) Assignee: TOTAL SA, Courbevoie (FR)

( * ) Notice: Subject to any disclaimer, the term of this patent is extended or adjusted under 35 U.S.C. 154(b) by 132 days.

(21) Appl. No.: 14/893,828

(22) PCT Filed: May 23, 2014

(86) PCT No.: PCT/EP2014/060643

§ 371 (c)(1),
(2) Date: Nov. 24, 2015

(87) PCT Pub. No.: WO2014/187947

PCT Pub. Date: Nov. 27, 2014

(65) Prior Publication Data

US 2016/0108333 A1 Apr. 21, 2016

(30) Foreign Application Priority Data

May 24, 2013 (EP) ..... 13305681

(51) Int. Cl.
*C10L 3/12* (2006.01)
*C10L 3/10* (2006.01)

(52) U.S. Cl.
CPC ..... *C10L 3/103* (2013.01); *C10L 3/12* (2013.01); *C10L 2290/06* (2013.01); *C10L 2290/08* (2013.01); *C10L 2290/10* (2013.01); *C10L 2290/541* (2013.01); *C10L 2290/543* (2013.01); *C10L 2290/545* (2013.01)

(58) Field of Classification Search
None
See application file for complete search history.

(56) References Cited

U.S. PATENT DOCUMENTS

| | | | | |
|---|---|---|---|---|
| 4,265,735 | A | 5/1981 | Audeh et al. | |
| 2006/0057056 | A1 | 3/2006 | Chretien | |
| 2013/0056677 | A1* | 3/2013 | Bela | B01D 53/1425 252/190 |
| 2016/0032206 | A1* | 2/2016 | Doong | C10L 3/103 95/135 |
| 2017/0081604 | A1* | 3/2017 | Matton | C10L 3/103 |

FOREIGN PATENT DOCUMENTS

| | | | |
|---|---|---|---|
| FR | 2 875 236 | A1 | 3/2006 |
| FR | 2 875 237 | A1 | 3/2006 |
| WO | WO 2011/090553 | A1 | 7/2011 |

OTHER PUBLICATIONS

PCT International Search Report for PCT/EP2014/060643, mailed Jul. 3, 2014, 3 pgs.

* cited by examiner

*Primary Examiner* — Tam M Nguyen
(74) *Attorney, Agent, or Firm* — Patterson Thuente Pedersen, P.A.

(57) ABSTRACT

The invention relates to a method for treating a hydrocarbon gas stream containing H2S and mercaptans, in which dialkyldisulfides are produced then removed by hydrogenation, as well as a device for carrying out said method.

15 Claims, 6 Drawing Sheets

INTEGRATED PROCESS FOR DIALKYLDISULFIDES TREATMENT

RELATED APPLICATIONS

The present application is a National Phase entry of PCT Application No. PCT/EP2014/060643, filed May 23, 2014, which claims priority from EP Patent Application No. 13305681.2, filed May 24, 2013, said applications being hereby incorporated by reference herein in their entirety.

FIELD OF THE INVENTION

The invention relates to a method for treating a hydrocarbon gas stream containing H2S and mercaptans, in which disulfide oil (DSO) is produced and then removed by hydrogenation, as well as a device for carrying said method.

BACKGROUND OF THE INVENTION

A sour hydrocarbon gas extracted from a gas field has to undergo several treatments to meet specific constraints dictated by commercial or security specifications. These treatments include for instance deacidification, dehydration, and liquefaction. Concerning H2S and other sulphur compounds, such as mercaptans, levels of few ppm are imposed for the treated gas.

Therefore, when a sour gas has a high content in mercaptans, it may requires further treatment of some gas or liquid cuts such as liquefied petroleum gas (LPG) in order to meet the commercial or security specifications. In that case, mercaptans may be removed by using a caustic solution which however produces an unwanted by-product named disulfide oil (DSO) which is composed of a mixture of dialkyldisulfides. To solve this problem, the most common practice is to mix DSO with large amount of condensate or oil if compatible with their specification. However, liquid production of gas is not always available onsite or there may be not enough liquid to mix with DSO. Therefore, DSO disposal is a very crucial issue in such fields.

FR 2875236 discloses a method for removing DSO comprising the hydrogenation of DSO wherein DSO is converted into H2S and hydrocarbons. This method uses pure hydrogen in order to perform hydrogenation of vaporized DSO. It also requires a specific plant dedicated to DSO wherein DSO is vaporized, hydrogen is produced or imported, and hydrogenation of DSO into H2S is performed. However, this process incurs a lot of capital expenditure (CAPEX). Furthermore, pure hydrogen is not always available at the site and needs to be imported or requires a hydrogen plant.

Therefore, there is need for a method for removing DSO within a process for treating a sour gas that is simpler and has a lower CAPEX.

SUMMARY OF THE INVENTION

The present invention meets all these needs by providing a method which can be integrated into the H2S treatment facility, in particular in the tail gas treatment unit (TGTU) downstream the Claus unit. The method of the invention actually utilizes equipments which are already implemented in the treatment of sour gas, which therefore allows a significant reduction of the CAPEX. Furthermore, the method utilizes the hydrogen which may be produced in the Claus unit for converting DSO into H2S and hydrocarbons.

Thus, in some embodiments, the method does not require the use of a separate hydrogen generator.

One object of the present invention is a method for treating a hydrocarbon gas stream comprising H2S and mercaptans, in which:

a) the hydrocarbon gas stream is separated into a sweet hydrocarbon gas stream and an acid gas stream comprising H2S,
b) the mercaptans are concentrated in at least one cut of said sweet hydrocarbon gas stream;
c) the mercaptans are extracted from the said cut and converted into dialkyldisulfides;
d) the acid gas stream comprising H2S is passed in a Claus unit, thereby producing a sulphur-containing stream and a Claus tail gas stream comprising SO2, which stream is then passed in a hydrogenation reactor A1 to convert SO2 into H2S and then passed in an absorber B for removing H2S, wherein:

e) the dialkyldisulfides formed at step c) are reacted with a hydrogen-containing stream in said hydrogenation reactor A1 or in a second hydrogenation reactor A2, thereby generating a gas stream comprising H2S, wherein:
   said hydrogen-containing stream is produced by a hydrogen generator C, and/or
   said hydrogen-containing stream is produced by the Claus unit, thereby being present in the Claus tail gas stream before or after the hydrogenation reactor A1, and
f) the gas stream comprising H2S formed at step e) is passed in the absorber B for removing H2S.

In one embodiment, all or part of the hydrogen-containing stream is produced by a hydrogen generator C, preferably by a reducing gas generator fed with a mixture of fuel gas, steam and air.

In one embodiment, all or part of the hydrogen-containing stream is produced by a Claus unit fed with a combustive agent comprising at least 20% of oxygen, thereby generating a Claus tail gas stream containing hydrogen.

In one embodiment, the dialkyldisulfides are reacted with a hydrogen-containing stream in the hydrogenation reactor A1, said hydrogen-containing stream being produced by a hydrogen generator C, thereby generating a gas stream containing H2S, which stream is then passed in the absorber B for removing H2S.

In one embodiment, the dialkyldisulfides are reacted with the Claus tail gas stream containing hydrogen in the hydrogenation reactor A1, thereby generating a gas stream containing H2S, which stream is then passed in the absorber B for removing H2S. In a particular embodiment, the hydrogenation reactor A1 is partly fed with a hydrogen containing stream produced by a hydrogen generator C.

In one embodiment, the dialkyldisulfides are reacted with a hydrogen-containing stream in the hydrogenation reactor A2, said hydrogen-containing stream being produced by a hydrogen generator C, thereby generating a gas stream containing H2S, which stream is then passed in the absorber B for removing H2S.

In one embodiment, one part of the Claus tail gas stream containing hydrogen is drawn off before the hydrogenation reactor A1 and reacted with the dialkyldisulfides in the second hydrogenation reactor A2, thereby producing a gas stream containing H2S, which stream is then passed in the absorber B for removing H2S. In a particular embodiment, the hydrogenation reactor A1 is partly fed with a hydrogen containing stream produced by a hydrogen generator C.

In one embodiment, one part of the Claus tail gas stream containing hydrogen is drawn off after the hydrogenation reactor A1 and reacted with the dialkyldisulfides in the second hydrogenation reactor A2, thereby producing a gas stream containing H2S, which stream is then passed in the absorber B for removing H2S. In a particular embodiment, both hydrogenation reactors A1 and A2 are partly fed with a hydrogen containing stream produced by a hydrogen generator C.

In one embodiment, a gas stream enriched in H2S is recovered from the absorber B and recycled to the Claus unit.

In one embodiment, the dialkyldisulfides are recovered from gas or liquid cuts, such as liquefied petroleum gas.

Another object of the present invention is a device for carrying out the method of the invention, said device comprising:

- a separation unit (2) for separating the hydrocarbon gas stream into a sweet hydrocarbon gas stream recovered in line (3) and an acid gas stream comprising H2S recovered in line (13),
- a Claus unit (14) fed with line (13), said Claus unit (14) having a Claus exit line (16) for recovering the Claus tail gas stream comprising SO2;
- optionally a tail gas heater (17) for heating the Claus tail gas stream,
- a hydrogenation reactor A1 fed with the hot Claus tail gas stream of line (16) and having a line (18) for recovering the gas stream at the exit of the hydrogenation reactor A1;
- an absorber B fed with line (18);
- a gas or liquid fractionation unit (6) for concentrating the mercaptans in at least one cut of sweet hydrocarbon gas or liquid stream, said gas or liquid fractionation unit (6)) being fed with line (3) and said cut being recovered in a line (8);
- a mercaptan removal unit (9) having a DSO line (12, 12*a*) for the recovery of dialkyldisulfides, said mercaptan removal unit (9) being fed with line (8);

wherein:

- either the DSO line (12) is connected to the hot Claus tail gas stream (16) so that the dialkyldisulfides are reacted with a hydrogen containing stream in said hydrogenation reactor A1,
- or:
  - one part of the Claus tail gas stream in lines (16, 18) is drawn off with a line (16*a*) connected before the hydrogenation reactor A1 or with a line (18*a*) connected after the hydrogenation reactor A1;
  - the device further comprises a second hydrogenation reactor A2 different from reactor A1, and said hydrogenation reactor A2 is fed with said line (16*a*, 18*a*) and with the DSO line (12*a*) and has an exit line (12*b*) for recovering a gas stream containing H2S;
  - said exit line (12*b*) is connected to line (18) so that the absorber B is fed with said gas stream containing H2S.

In one embodiment, the Claus unit (14) is fed with a combustive agent comprising at least 20% of oxygen, thereby generating a Claus tail gas stream containing hydrogen.

In one embodiment, the hydrogenation reactor A1 or the hydrogenation reactor A2 if applicable or both hydrogenation reactors are further fed with a hydrogen generator C, preferably by a reducing gas generator fed with a mixture of fuel, steam and air.

In one embodiment, the absorber B has a line (19) connected to the Claus unit (14) for recycling a gas stream enriched in H2S recovered from the absorber B to the Claus unit (14).

DETAILED DESCRIPTION OF THE INVENTION

The process according to the invention applies to the treatment of a hydrocarbon gas stream containing H2S and mercaptans, especially to a sour gas (natural gas), where gas or liquid streams such as light hydrocarbons and LPG are extracted from the gas.

In the following description, the feeding of a unit or any other part of the device with a line includes direct feeding as well as indirect feeding, for instance where the feeding stream is subjected to a treatment prior to be fed to said unit or part, such as a dehydration treatment.

In the following description, the example of a sour gas containing H2S, CO2 and mercaptans from which light hydrocarbons and LPG are extracted is used but without restraint to the scope of the invention.

The invention is now described in more details by referring to FIGS. 1-6.

Figure 1:
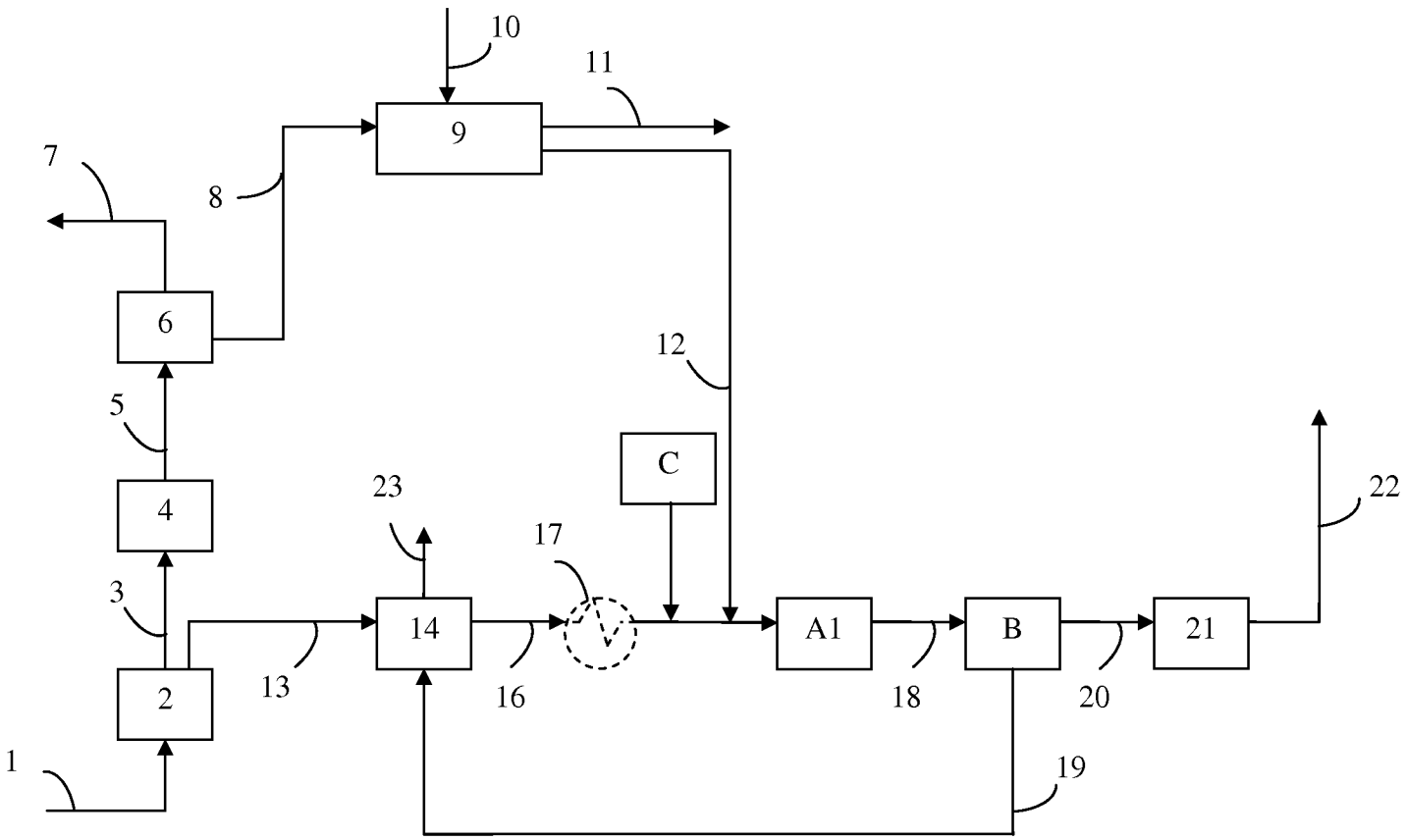
FIG. 1 is a schematic representation of the process and installation of the invention, wherein the dialkyldisulfides are reacted with a hydrogen-containing stream in the hydrogenator A1, said hydrogen being produced by a hydrogen generator C.

FIG. 1 represents a first embodiment of the invention.

According to FIG. 1, the sour gas 1 is sweetened by removing the acid gases H2S and CO2 in a separation unit 2, such as an amine washing unit. Amine solutions are well known by the person skilled in the art. According to the desired specification, the amine solutions may include DEA (di-ethanol amine), MDEA (methyl-di-ethanol amine) or activated MDEA (e.g. MDEA/piperazine or MDEA/hydroxyethyl piperazine) or any other amine-based solution known in the art as an absorbing solution. The acid gas enriched in H2S and CO2 and the sweetened gas are respectively recovered in lines 13 and 3. The sweetened gas 3 is dried in a dehydration unit 4 by using a drying method. Drying methods are well known by the person skilled in the art. According to the water dew point desired, the drying method may use a dehydration solvent such as glycol or triethylene glycol (TEG), or molecular sieves. The dried and sweetened gas 5 is then introduced into a gas or liquid fractionation unit 6 for concentrating the mercaptans into gas or liquid cuts. The unit 6 generally assures the fractionation; classically it comprises a deethanizer, a depropanizer and a debutanizer. The gas or liquid cuts are extracted via line 8 (LPG stream). Light hydrocarbons are recovered in line 7. The mercaptans initially present in the sour gas 1 are thus found concentrated in the LPG stream 8. They are treated by washing the gas or liquid cuts with a caustic solution 10, such as sodium hydroxide, in the unit 9, thereby producing DSO in line 12. The gas or liquid cuts which are free from mercaptans, under the commercial specification values, are extracted via line 11. The sodium hydroxide solution used may be regenerated with air (not represented) before being returned in unit 9. We will see later how the DSO are treated.

The acid gas enriched in H2S and CO2 13 produced from the amine washing unit 2 is introduced into a Claus unit 14 to convert H2S into liquid sulphur. The produced sulphur is recovered from unit 14 by line 23. The Claus tail gas stream exiting from the Claus unit 14 is recovered by line 16.

The Claus unit is fed with a combustive agent (not represented) comprising oxygen in order to allow oxidation of H2S. The combustive agent may be air, pure oxygen or oxygen plus air, i.e. a mixture mostly comprising oxygen and nitrogen, wherein the amount of nitrogen does not exceed 80%.

Pure oxygen or oxygen plus air may be obtained from atmospheric air by using an air separation unit (ASU) which separates atmospheric air into its primary components: mostly nitrogen and oxygen, and sometimes also argon and other rare inert gases. Any suitable method of separation may used in the process of the invention, for instance cryogenic distillation.

The use of pure oxygen or oxygen plus air as a combustive agent in the reactor furnace promotes side reactions resulting in the formation of hydrogen. Therefore, the Claus tail gas stream 16 may contain minor amounts of hydrogen (up to 5%).

The Claus tail gas stream 16 is then introduced into a Tail Gas Treatment Unit (TGTU) in order to convert the sulphur compounds of the tail gas into H2S. The TGTU generally comprises three major equipments in the direction of flow:

- a hydrogenation reactor A1 for converting the sulphur compounds of the Claus tail gas stream 16 into H2S,
- a quench contactor for removing water from the gas stream (not represented) and
- an absorber B for separating the sulphur compounds (mainly H2S) from the other constituents of the Claus tail gas stream.

The TGTU may further comprise a tail gas heater 17 for heating the Claus tail gas stream 16 if needed (represented with dotted lines).

As a result, two streams are recovered at the exit of the TGTU: a CO2/N2 enriched gas stream 20 and a gas stream enriched in sulphur compounds 19.

Hydrogenation reactors are well known by the person skilled in the art. The hydrogenation reactor A1 typically comprises a catalyst bed, such as CoMo, where sulphur compounds such as SO2, S, COS and CS2 are converted into H2S.

If the amount of hydrogen contained in the Claus tail gas stream 16 is not sufficient to convert all the sulphur compounds into H2S, the hydrogenation reactor A1 has to be further fed with a supplemental hydrogen stream produced by a hydrogen generator C. According to the invention, a hydrogen generator is any external source of hydrogen, such as a reducing gas generator or a hydrogen plant. If the hydrogen is produced by a reducing gas generator, the temperature of the produced hydrogen stream may be high enough to perform hydrogenation and a tail gas heater 17 may not be required in that case. However, if the hydrogen is produced by a hydrogen plant or by any external source of hydrogen, a tail gas heater 17 may be required to heat the Claus tail gas stream 16 to a temperature suitable for performing hydrogenation of the sulphur compounds. The hydrogen generator C also heats the Claus tail gas stream 16 by using the hot gas from the hydrogen generator which is mixed with the Claus tail gas stream 16.

In the hydrogenation reactor A1, the temperature should be of at least 150° C., preferably around 220° C. The H2 generator C generally operates with air, steam and fuel gas. The pressure in the hydrogenation reactor A1 is generally comprised between 1.1 and 1.8 bar, preferably between 1.3 to 1.6 bar.

The converted gas stream 18 recovered at the exit of the hydrogenation reactor A1 may be passed through a quench contactor (not represented), preferably a water-quench tower, in order to remove the excess of water from the gas stream. The dehydrated gas stream exiting the quench tower is then passed through the absorber B, wherein sulphur compounds, mainly H2S, are absorbed by an absorbing solution. Preferably, the absorber B is an amine-based unit but any other suitable absorbing unit may be used.

The absorbing solution loaded with sulphur compounds is generally recovered from the absorber B and passed through a stripper column (not represented) in order to separate the absorbing solution from the sulphur compounds. The absorbing solution may be recovered at the bottom of the stripper column and recycled to the absorber B. A gas stream enriched with sulphur compounds 19 is recovered at the head of the column and is recycled upstream to the Claus unit 14.

The CO2/N2 enriched gas stream 20 is then introduced into an incinerator 21 to burn in presence of fuel and air and to produce flue gas stream 22.

According to the embodiment of FIG. 1, the Claus tail gas stream 16 is mixed with a hydrogen stream produced by the hydrogen generator C which is required to convert the dialkyldisulfides into H2S, thereby resulting in a hot gas mixture. The DSO in line 12 which is produced from unit 9 is introduced into this hot gas mixture, wherein it is vaporized. The resulting gaseous stream is then introduced into the hydrogenation reactor A1 where dialkyldisulfides are converted into H2S. In the embodiment of FIG. 1, the hydrogen stream is produced by a hydrogen generator C.

Figure 2:
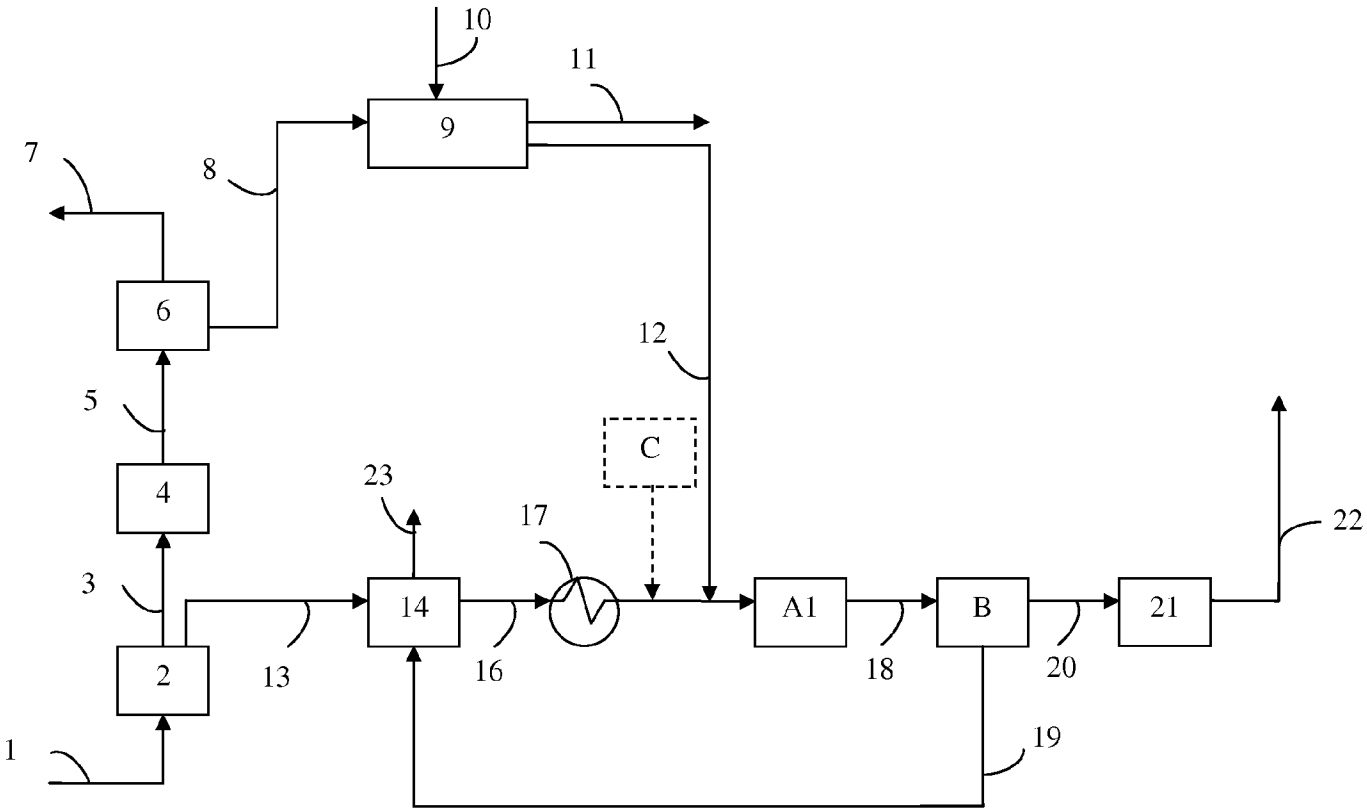
FIG. 2 is a schematic representation of the process and installation of the invention, wherein hydrogen is produced by the Claus unit, thereby producing a Claus tail gas stream containing hydrogen. The dialkyldisulfides are reacted with Claus tail gas stream containing hydrogen in the hydrogenator A1. Optionally, the hydrogenator A1 is partly fed with a hydrogen-containing stream produced by a hydrogen generator C (represented in dotted lines).

However, as noted above, when the Claus unit is fed with pure oxygen or oxygen plus air as a combustive agent, side reactions resulting in the formation of hydrogen may be promoted in the Claus unit. Therefore, the Claus tail gas stream 16 may contain hydrogen in an amount sufficient to perform the conversion of the dialkyldisulfides into H2S and hydrocarbons. In that case, there is no need to use a hydrogen generator C. However, in order to achieve the specific hydrogenation temperature, tail gas heater 17 is required to heat the Claus tail gas stream containing the hydrogen. FIG. 2 represents this embodiment of the invention wherein hydrogen is produced within the Claus unit 14 (the other conditions being identical to the embodiment of FIG. 1). In that case, the hydrogen generator C is optional (represented with dotted line). It is used only if the amount of hydrogen in the Claus tail gas stream 16 is not sufficient to convert the dialkyldisulfides into H2S and hydrocarbons In this case, the tail gas heater 17 is compulsory to preheat the tail gas up to hydrogenation temperature.

Figure 3:
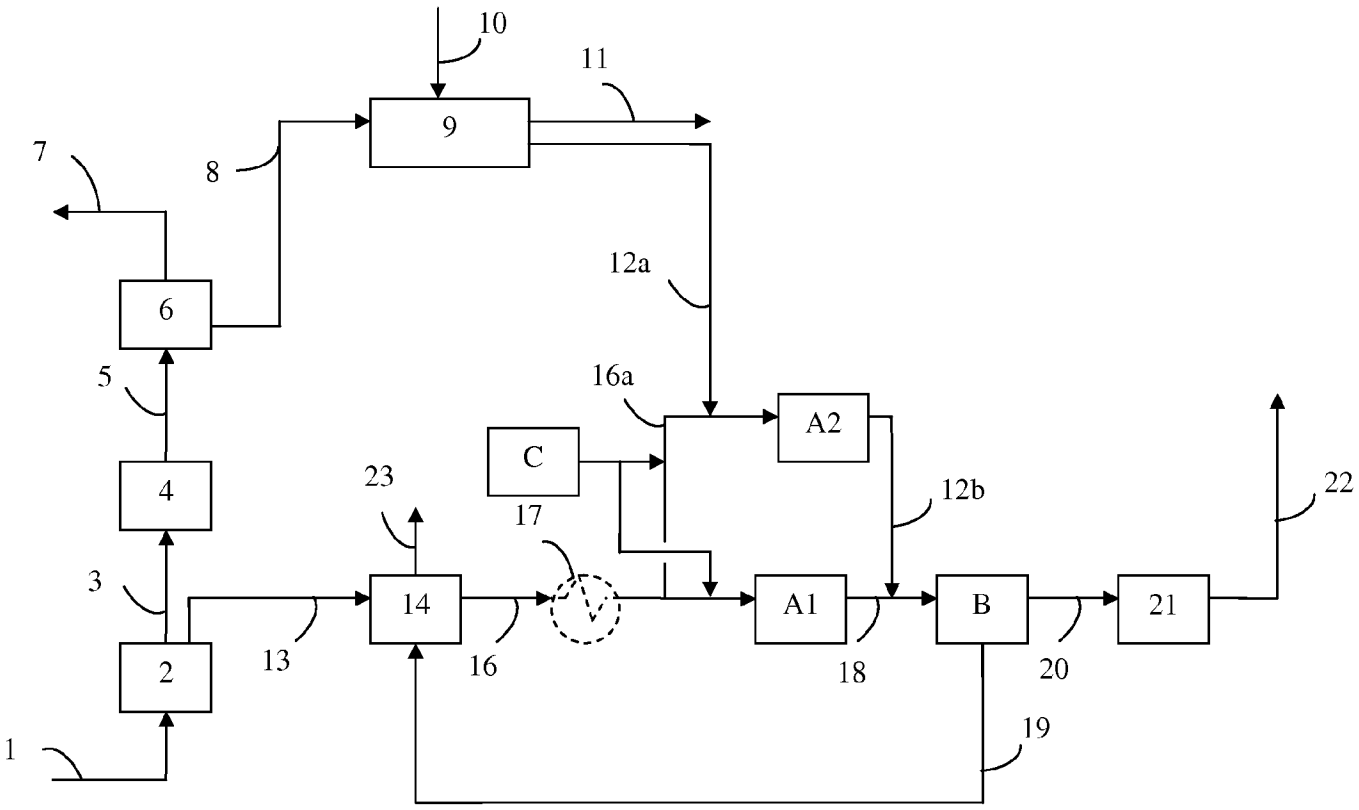
FIG. 3 is a schematic representation of the process and installation of the invention, wherein one part of the Claus tail gas stream containing hydrogen is drawn off before the hydrogenation reactor A1 and reacted with the dialkyldisulfides in a hydrogenation reactor A2. Both hydrogenation reactors A1 and A2 are fed with a hydrogen-containing stream produced by a hydrogen generator C.

FIG. 3 represents another embodiment of the invention wherein:

- One part of the hot Claus tail gas stream 16 containing hydrogen is drawn off before the hydrogenation reactor A1 in line 16*a*,
- DSO 12*a* is introduced into the hot Claus tail gas stream 16*a* wherein it is vaporized,
- The resulting gaseous stream is then introduced into a hydrogenation reactor A2 different than A1,
- The other conditions are identical to those of embodiment of FIG. 1.

In order to convert the dialkyldisulfides into H2S, the hydrogenation reactor A2 is fed with hydrogen produced by a hydrogen generator C. The produced stream containing H2S 12*b* is then introduced into the TGTU in order to be treated by the absorber B.

Figure 4:
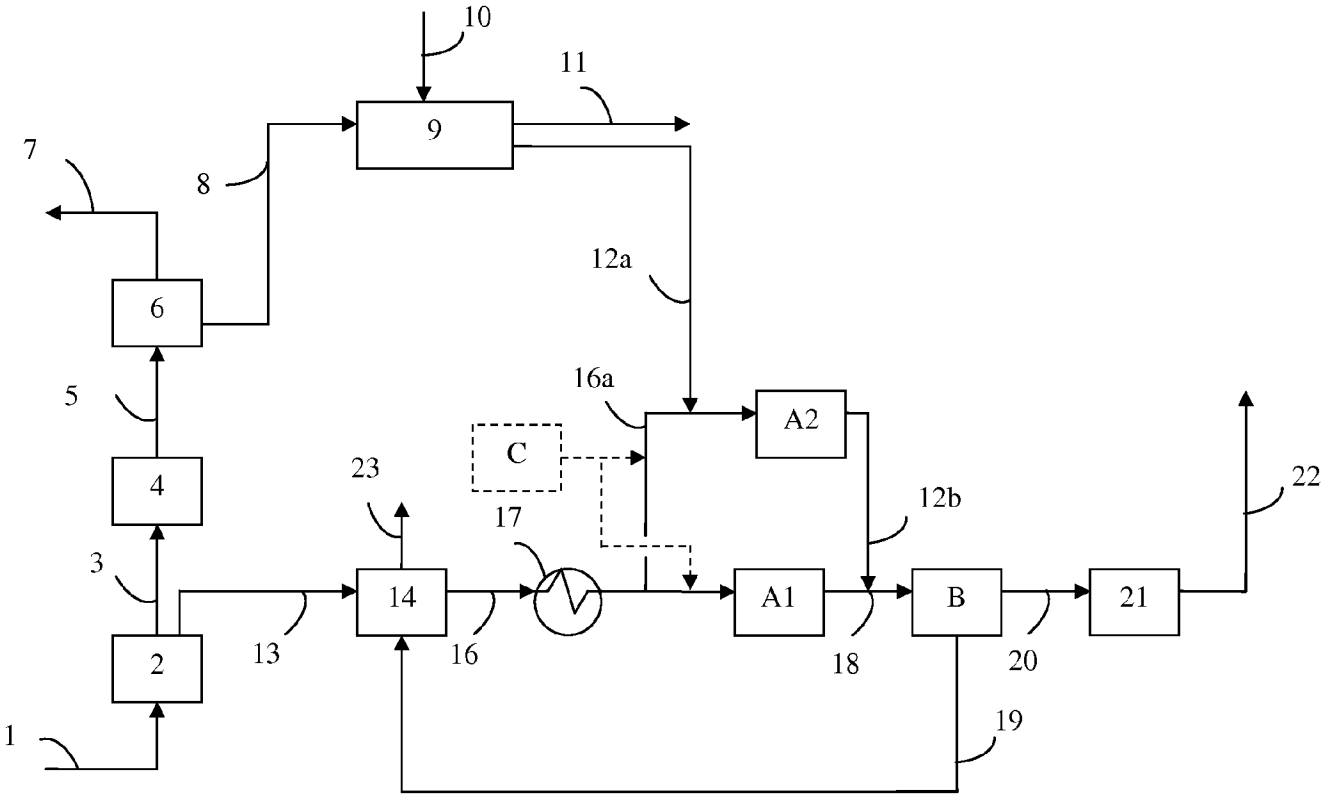
FIG. 4 is a schematic representation of the process and installation of the invention, wherein hydrogen is produced by the Claus unit, thereby producing a Claus tail gas stream containing hydrogen. One part of the Claus tail gas stream containing hydrogen is drawn off before the hydrogenation reactor A1 and reacted with the dialkyldisulfides in a hydrogenation reactor A2. Optionally, both the hydrogenators A1 and A2 are fed with a hydrogen containing stream produced by a hydrogen generator C (represented in dotted lines).

FIG. 4 represents another embodiment of the invention wherein:

- hydrogen is produced within the Claus unit 14,
- Claus tail gas 16 is heated in the tail gas heater 17,
- one part of the hot Claus tail gas stream 16 containing hydrogen is drawn off before the hydrogenation reactor A1 in line 16*a*,
- DSO 12*a* is introduced into the hot Claus tail gas stream 16*a* wherein it is vaporized,
- The resulting gaseous stream is then introduced into a hydrogenation reactor A2 different than A1,
- the other conditions are identical to those of embodiment of FIG. 2.

Since hydrogen is produced within the Claus unit 14, the hydrogen generator C is optional (represented with dotted line). It is used only if the amount of hydrogen in the Claus tail gas stream 16, 16*a* is not sufficient to convert the dialkyldisulfides into H2S and hydrocarbons. In this case, the tail gas heater 17 is compulsory to preheat the tail gas up to hydrogenation temperature.

The volume of gas drawn off from the Claus tail gas stream in line 16*a* will depend on the content of hydrogen in the Claus tail gas stream 16 and the amount of DSO which requires to be converted into H2S. The drawn off volume may be comprised between 5% vol. and 60% vol. In order to convert the dialkyldisulfides into H2S and hydrocarbons, the hydrogenation reactor A2 may be fed with hydrogen produced by a hydrogen generator C. If there is not enough H2 in the Claus tail gas, the hydrogen generator C can also feed the hydrogenator A1. The produced stream containing H2S 12*b* is then introduced into the TGTU in order to be treated by the absorber B.

Figure 5:
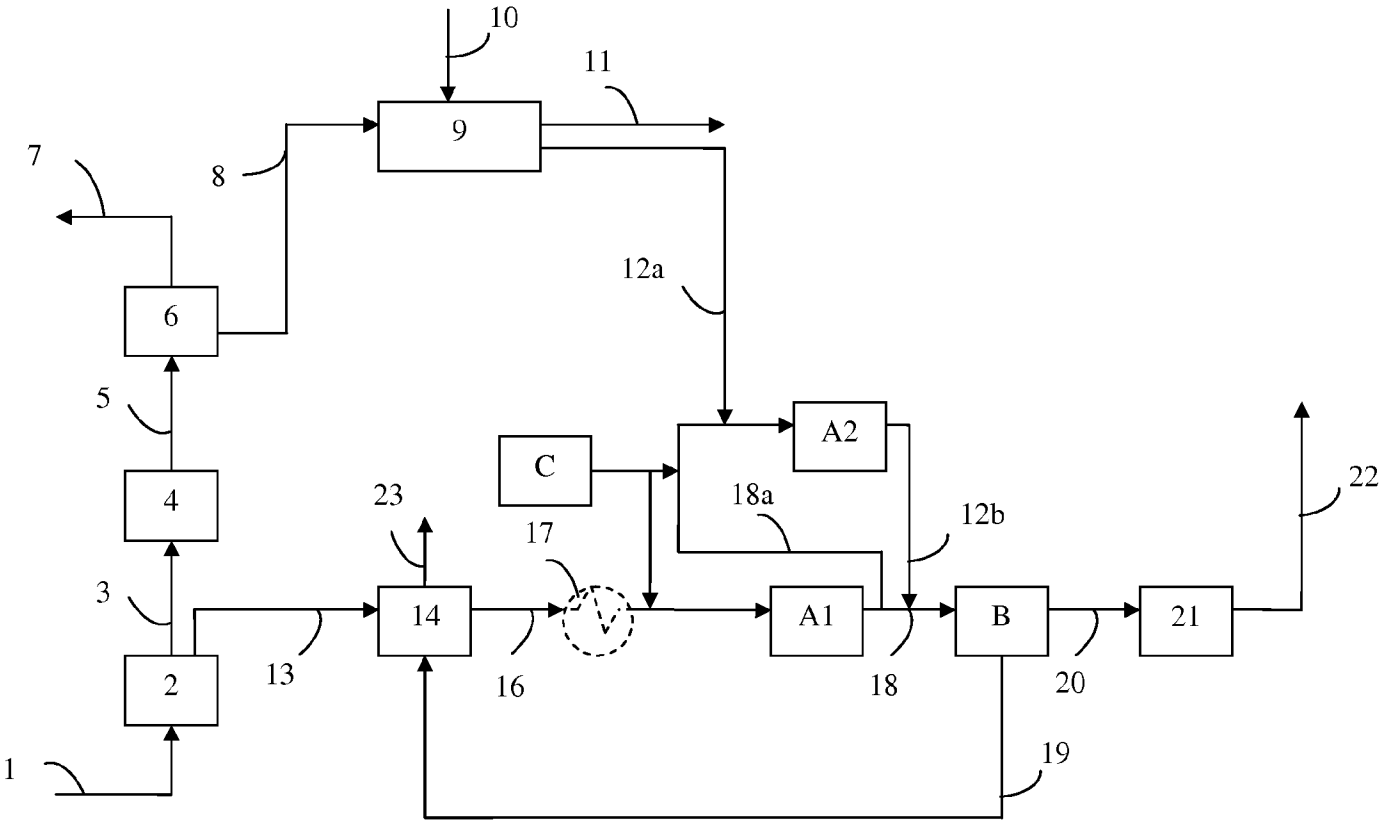
FIG. 5 is a schematic representation of the process and installation of the invention, wherein hydrogen is produced by the Claus unit, thereby producing a Claus tail gas stream containing hydrogen. One part of the Claus tail gas stream containing hydrogen is drawn off after the hydrogenation reactor A1 and reacted with the dialkyldisulfides in a hydrogenation reactor A2. Both the hydrogenators A1 and A2 are fed with a hydrogen containing stream produced by a hydrogen generator C.
Figure 6:
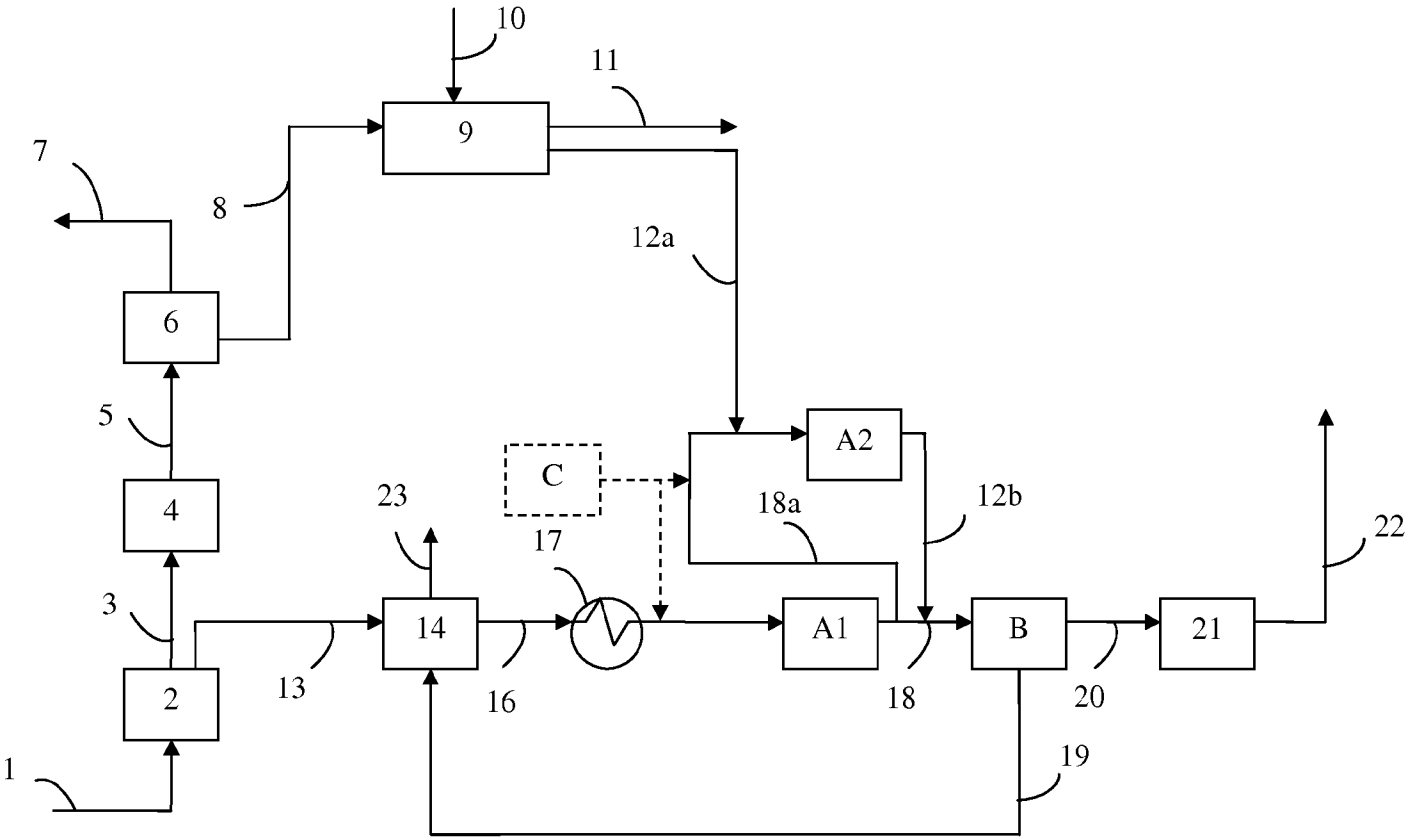
FIG. 6 is a schematic representation of the process and installation of the invention, wherein hydrogen is produced by the Claus unit, thereby producing a Claus tail gas stream containing hydrogen. One part of the Claus tail gas stream containing hydrogen is drawn off after the hydrogenation reactor A1 and reacted with the dialkyldisulfides in a hydrogenation reactor A2. Optionally, both the hydrogenators A1 and A2 are fed with a hydrogen containing stream produced by a hydrogen generator C (represented in dotted lines).

FIGS. 5 and 6 represent other embodiments of the invention wherein:

- hydrogen is produced within the Claus unit 14,
- one part of the hot tail gas stream containing hydrogen is drawn off after the hydrogenation reactor A1 in line 18*a*,
- DSO 12*a* is introduced into the Claus tail gas stream 18*a* wherein it is vaporized,
- The resulting gaseous stream is then introduced into a hydrogenation reactor A2 different than A1,
- the other conditions are identical to those of embodiment of FIG. 1.

The Claus tail gas stream 16 or the hot tail gas stream 18*a* or both streams 16 and 18*a* may not contain a sufficient amount of hydrogen to perform hydrogenation respectively in the hydrogenation reactor A1 and/or the hydrogenation reactor A2. In that case, a hydrogen generator C is required to feed the hydrogenation reactors A1 and/or A2 with a supplemental source of hydrogen (FIG. 5). The produced stream containing H2S 12*b* is then introduced into the TGTU.

Conversely, the Claus tail gas stream 16 or the hot tail gas stream 18*a* or both streams 16 and 18*a* may contain hydrogen if the hydrogen produced in the Claus unit 14 has not been completely consumed in the hydrogenation reactor A1 and/or the hydrogenation reactor A2. In that case, the hydrogen generator C is optional (represented with dotted line—FIG. 6). It is used only if the amount of hydrogen in the Claus tail gas stream 16 and/or in the drawn off tail gas stream 18*a* is not sufficient to convert the dialkyldisulfides into H2S and hydrocarbons. In this case, the tail gas heater 17 is compulsory to preheat the tail gas up to hydrogenation temperature. The produced stream containing H2S 12b is then introduced into the TGTU in order to be treated by the absorber B.

Therefore, as we see from the embodiments illustrated by FIGS. 1-6, the method of the invention allows the disposal of DSO by sending it to equipments which are classically implemented in the treatment of sour gas, in particular the TGTU, and more particularly the hydrogenation reactor and absorber of the TGTU, which therefore allows a significant reduction of the CAPEX. Furthermore, the method utilizes the hydrogen which may be produced in the Claus unit for converting DSO into H2S. Thus, in some embodiments, the method does not require the use of a separate hydrogen generator dedicated to the treatment of DSO.

Another object of the present invention is a device for carrying out the method of the invention, said device comprising:

- a separation unit 2 for separating the hydrocarbon gas stream into a sweet hydrocarbon gas stream recovered in line 3 and an acid gas stream comprising H2S recovered in line 13,
- a Claus unit 14 fed with line 13, said Claus unit 14 having a Claus exit line 16 for recovering the Claus tail gas stream comprising H2S and SO2;
- optionally a tail gas heater 17 for heating the Claus tail gas stream, a hydrogenation reactor A1 fed with the hot Claus tail gas stream of line 16 and having a line 18 for recovering the gas stream at the exit of the hydrogenation reactor A1;

an absorber B fed with line 18;

a gas or liquid fractionation unit 6 for concentrating the mercaptans in at least one cut of sweet hydrocarbon gas or liquid stream, said gas or liquid fractionation unit 6 being fed with the line 3 and said cut being recovered in a line 8;

a mercaptan removal unit 9 having a DSO line 12, 12*a* for the recovery of dialkyldisulfides, said mercaptan removal unit 9 being fed with line 8;

wherein:

either the DSO line 12 is connected to the hot Claus tail gas stream 16 so that the dialkyldisulfides are reacted with a hydrogen containing stream in said hydrogenation reactor A1, or:

one part of the Claus tail gas stream in lines 16, 18 is drawn off with a line 16*a* connected before the hydrogenation reactor A1 or with a line 18*a* connected after the hydrogenation reactor A1;

the device further comprises a second hydrogenation reactor A2 different from reactor A1, and said hydrogenation reactor A2 is fed with said line 16*a*, 18*a* and with the DSO line 12*a* and has an exit line 12*b* for recovering a gas stream containing H2S;

said exit line 12*b* is connected to line 18 so that the absorber B is fed with said gas stream containing H2S.

The separation unit 2 may be typically an amine washing unit. According to the desired specification, the amine solutions may include DEA (di-ethanol amine), MDEA (methyl-di-ethanol amine) or activated MDEA or any other amine-based solution known in the art as an absorbing solution.

The Claus unit is fed with a combustive agent comprising oxygen in order to allow oxidation of H2S. The combustive agent may be air, pure oxygen or a mixture mostly comprising oxygen and nitrogen, wherein the amount of nitrogen does not exceed 80%. The device may thus further comprise an air separation unit (ASU) which is able to separate atmospheric air into its primary components: mostly nitrogen and oxygen, and sometimes also argon and other rare inert gases, to produce pure oxygen or a gas enriched in oxygen.

In one embodiment, the Claus unit 14 is fed with a combustive agent comprising at least 20% of oxygen, thereby generating a Claus tail gas stream containing hydrogen.

The device may further comprises a dehydration unit 4 connected between the separation unit 3 and the gas or liquid fractionation unit 6 for drying the sweetened gas 3. According to the water dew point desired, the drying unit 4 may use a dehydration solvent such as glycol or triethylene glycol (TEG), or molecular sieves.

The hydrogenation reactors A1 or A2 typically comprise a catalyst bed, such as CoMo, where sulphur compounds such as SO2, S, COS and CS2 are converted into H2S.

In one embodiment, the hydrogenation reactor A1 or the hydrogenation reactor A2 if applicable or both hydrogenation reactors are further fed with a hydrogen generator C, preferably by a reducing gas generator fed with a mixture of fuel, steam and air.

The absorber B may be an amine-based unit but any other suitable absorbing unit may be used. The device may further comprise a stripper column (not represented) in order to separate the absorbing solution from the sulphur compounds.

The gas or liquid fractionation unit 6 allows concentrating the mercaptans into gas or liquid cuts. The unit 6 generally assures the fractionation; classically it comprises a deethaniser, a depropaniser and a debutaniser.

The mercaptan removal unit 9 allows the production of DSO in line 12 by washing the gas or liquid cuts with a caustic solution 10, such as sodium hydroxide. The gas or liquid cuts which are free from mercaptans, under the commercial specification values, are extracted via line 11. The sodium hydroxide solution used may be regenerated with air (not represented) before being returned in unit 9. We will see later how the DSO are treated.

In one embodiment, the absorber B has a line 19 connected to the Claus unit 14 for recycling a gas stream enriched in H2S recovered from the absorber B to the Claus unit 14.

The following example provides another illustration of the invention without providing any limitation.

EXAMPLE

The example given below applies to the first embodiment of the method of the invention as described in FIG. 1.

The natural gas is successively treated in units 2 and 4 and liquefied in unit 6, thereby producing a stream of LPG in line 8 and a stream of light hydrocarbons in line 7. During liquefaction, propane, butane and mercaptans are extracted together and sent to the unit 9 where they are treated by washing the gas with a caustic solution 10 of sodium hydroxide, thereby producing DSO in line 12.

The acid gas enriched in H2S and CO2 13 produced from the amine washing unit 2 is introduced into the Claus unit 14 to convert H2S into liquid sulphur and to form a Claus tail gas stream which is recovered in line 16 and then heated by a tail gas heater 17.

The hot Claus tail gas stream from unit 17 and the DSO produced in line 12 are mixed and introduced into the hydrogenation reactor A1 of the Tail Gas Treatment Unit (TGTU) wherein the sulphur compounds are converted into H2S and hydrocarbons, and recovered in line 18. Then, the mixture is sent to the absorber B of the TGTU for separating the sulphur compounds (mainly H2S) from the other constituents of the stream of line 18.

At the exit of the absorber B, two streams are recovered: a CO2/N2 enriched gas stream 20 and a gas stream enriched in sulphur compounds 19. The CO2/N2 enriched gas stream 20 is sent to the incinerator 21 and the gas stream enriched in sulphur compounds 19 is recycled into the Claus unit 14.

Hereunder, the table displays the compositions of the following streams: 1, 8, 12, 13, 16, 18, 19 and 20. All the compounds that are formed during the different secondary reactions do not appear in said table, these compounds are minor and do not affect the material balance.

Without any indications, the values are in mol. percent and ppm are indicated.

| Com- | Stream n° | | | | | | | |
|---|---|---|---|---|---|---|---|---|
| pounds | (1) | (8) | (12) | (13) | (16) | (18) | (19) | (20) |
| CO2 | 3.07 | | | 50 | 15 | 16 | 61 | 21 |
| H2S | 1.13 | | | 40 | 0.9 | 1.7 | 33 | 90 ppm |
| HCs | 91.0 | 99 | | | | Traces | | Traces |

-continued

| Com- | Stream n° | | | | | | | |
|---|---|---|---|---|---|---|---|---|
| pounds | (1) | (8) | (12) | (13) | (16) | (18) | (19) | (20) |
| H20 | 0.042 | | | 10 | 36 | 35 | 6 | 12 |
| N2 | 4.64 | | | | 46 | 45 | | 64 |
| H2 | | | | | 1.6 | 2 | | 2.6 |
| SO2 | | | | | 0.45 | | | |
| RSH | 96 ppm | 4000 ppm | | | | | | |
| DSO | | | 100 | | | | | |

DSO being a byproduct of the mercaptans removal unit, it requires specific disposal. Many times, it is a problematic issue to dispose off this DSO. The above data show that DSO can be hydrogenated in the TGTU hydrogenation reactor. With DSO hydrogenation, all the sulphur compounds of DSO can be converted into H2S, which is in turn converted into elemental sulphur in the Claus unit.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A method for treating a hydrocarbon gas stream containing H2S and mercaptans, the method comprising:

a) separating the hydrocarbon gas stream into a sweet hydrocarbon gas stream and an acid gas stream comprising H2S, b) concentrating the mercaptans in at least one cut of said sweet hydrocarbon gas stream;

c) extracting the mercaptans from the said cut and converting into dialkyldisulfides;

d) passing the acid gas stream comprising H2S in a Claus unit, thereby producing a sulphur-containing stream and a Claus tail gas stream comprising SO2, which stream is then passed in a hydrogenation reactor to convert SO2 into H2S and then passed in an absorber for removing H2S, wherein:

e) the dialkyldisulfides formed at step c) are reacted with a hydrogen containing stream in said hydrogenation reactor or in a second hydrogenation reactor, thereby generating a gas stream comprising H2S, wherein:

said hydrogen-containing stream is produced by a hydrogen generator, and/or said hydrogen-containing stream is produced by the Claus unit, thereby being present in the Claus tail gas stream before or after the hydrogenation reactor, and f) the gas stream comprising H2S formed at step e) is passed in the absorber for removing H2S.

2. The method according to claim 1, wherein all or part of the hydrogen containing stream is produced by a hydrogen generator, preferably by a reducing gas generator fed with a mixture of fuel gas, steam and air.

3. The method according to claim 1, wherein all or part of the hydrogen-containing stream is produced by a Claus unit fed with a combustive agent comprising at least 20% of oxygen, thereby generating a Claus tail gas stream containing hydrogen.

4. The method according to claim 1, wherein the dialkyidisulfides are reacted with said hydrogen-containing stream in the hydrogenation reactor, said hydrogen-containing stream being produced by a hydrogen generator, thereby generating a gas stream comprising H2S, which stream is then passed in the absorber for removing H2S.

5. The method according to claim 1, wherein the dialkyldisulfides are reacted with the Claus tail gas stream comprising hydrogen in the hydrogenation reactor, thereby generating a gas stream comprising H2S, which stream is then passed in the absorber for removing H2S.

6. The method according to claim 1, wherein one part of the Claus tail gas stream comprising hydrogen is drawn off before the hydrogenation reactor and reacted with the dialkyldisuifides in the second hydrogenation reactor, thereby producing a gas stream comprising H2S, which stream is then passed in the absorber for removing H2S.

7. The method according to claim 1, wherein one part of the Claus tail gas stream comprising hydrogen is drawn off after the hydrogenation reactor and reacted with the dialkyldisulfides in the second hydrogenation reactor, thereby producing a gas stream comprising H2S, which stream is then passed in the absorber for removing H2S.

8. The method according to claim 6, wherein the hydrogenation reactor and/or secondary hydrogenation reactor are fed with a hydrogen-containing stream produced by a hydrogen generator.

9. The method according to claim 1, wherein a gas stream comprising H2S is recovered from the absorber and recycled to the Claus unit.

10. The method according to claim 1, wherein the dialkyldisulfides are recovered from gas or liquid cuts, such as liquefied petroleum gas.

11. A device for carrying out the method according to claim 1, said device comprising:

a separation unit for separating the hydrocarbon gas stream into a sweet hydrocarbon gas stream and an acid gas stream comprising H2S, a Claus unit fed with the acid gas stream, said Claus unit having a Claus exit line for recovering the Claus tail gas stream comprising SO2;

optionally a tail gas heater for heating the Claus tail gas stream, a hydrogenation reactor fed with the hot Claus tail gas stream and having a recovery line for recovering the gas stream at the exit of the hydrogenation reactor;

an absorber fed with the recovery line;

a gas or liquid fractionation unit for concentrating the mercaptans in at least one cut of sweet hydrocarbon gas or liquid stream, said gas or liquid fractionation unit being fed with the sweet hydrocarbon gas stream and said cut being recovered in a LPG stream;

a mercaptan removal unit having a DSO line for the recovery of dialkyldisulfides, said mercaptan removal unit being fed with the LPG stream;

wherein:

either the DSO line is connected to the hot Claus tail gas stream so that the dialkyldisulfides are reacted with a hydrogen containing stream in said hydrogenation reactor, or:

one part of the Claus tail gas stream is drawn off with a hot Claus tail gas stream connected before the hydrogenation reactor or with a hot Claus tail gas stream connected after the hydrogenation reactor;

the device further comprises a second hydrogenation reactor, and said second hydrogenation reactor is fed with said hot Claus tail gas stream and with the DSO line and has an exit line for recovering a gas stream containing H2S;

said exit line is connected so that the absorber is fed with said gas stream containing H2S.

12. The device according to claim 11, wherein the Claus unit is fed with a combustive agent comprising at least 20% of oxygen, thereby generating a Claus tail gas stream comprising hydrogen.

13. The device according to claim 11, wherein the hydrogenation reactor or the second hydrogenation reactor if applicable or both hydrogenation reactors are further fed with a hydrogen generator, preferably by a gas reducing generator fed with a mixture of fuel and air.

14. The device according to claim 11, wherein the hydrogenation reactor A1 or the second hydrogenation reactor if applicable or both hydrogenation reactors are further fed with all external H2-containing stream.

15. The device according to claim 11, wherein the absorber has a line connected to the Claus unit for recycling a gas stream comprising H2S recovered from the absorber B to the Claus unit.

* * * * *